US012478148B1

(12) United States Patent
Feinstein et al.

(10) Patent No.: US 12,478,148 B1
(45) Date of Patent: Nov. 25, 2025

(54) BAND WITH BISTABLE ACTUATION MECHANISM EMPLOYING FLEXIBLE ELEMENT

(71) Applicant: Peter A Feinstein Patents LLC, Palm Beach Gardens, FL (US)

(72) Inventors: Peter A. Feinstein, Palm Beach Gardens, FL (US); Ivyann Oveson Running, Orem, UT (US); Brian Jensen, Orem, UT (US); Nathan Usevitch, Vineyard, UT (US); Bryce David Parkinson, State College, PA (US); Andrew Geyser, Fort Collins, CO (US); Carter Stentzel, San Antonio, TX (US); Isaac Weaver, Provo, UT (US)

(73) Assignee: Peter A Feinstein Patents LLC, Palm Beach Gardens, FL (US)

( * ) Notice: Subject to any disclaimer, the term of this patent is extended or adjusted under 35 U.S.C. 154(b) by 0 days.

(21) Appl. No.: 19/283,687

(22) Filed: Jul. 29, 2025

(51) Int. Cl.
*A44C 5/12* (2006.01)
*A44C 5/00* (2006.01)

(52) U.S. Cl.
CPC ..... *A44C 5/12* (2013.01); *A44C 5/0084* (2013.01)

(58) Field of Classification Search
CPC ..... A44C 5/12; A44C 9/0038; A44C 5/02; A44C 5/06; E05D 2003/027;
(Continued)

(56) References Cited

U.S. PATENT DOCUMENTS 2,009,483 A * 7/1935 Dinhofer ..... A44C 5/142 24/265 WS
2,009,484 A * 7/1935 Dinhofer ..... A44C 5/14 24/265 WS
(Continued)

FOREIGN PATENT DOCUMENTS

CH 705215 B1 1/2013
CN 204062396 U 12/2014
(Continued)

OTHER PUBLICATIONS

Hafez, M. "Optimized binary modular reconfigurable robotic devices", Article in IEEE/ASME Transactions on Mechatronics—Apr. 2003 https://www.researchgate.net/publication/3414912.
(Continued)

*Primary Examiner* — Emily M Morgan
(74) *Attorney, Agent, or Firm* — Forge IP, PLLC; Todd M. Oberdick

(57) ABSTRACT

A band has at least one actuator including first and second members connected to one another so as to be pivotable between open and closed positions. The first member includes a pair of deformable beams, each having a protuberance extending therefrom. The second member includes a series of ridges and valleys formed therein that are sized, shaped and positioned to cooperate with the protuberances extending from the beams. In the open position and the closed position, the protuberances align with the valleys, such that the beams are in a relaxed state and generally parallel with each other, and when the first and second members are pivoted to positions between the open and closed positions, the protuberances cooperate with the ridges, such that the beams are elastically deformed so as to no longer be parallel with each other, and so as to store strain energy.

23 Claims, 9 Drawing Sheets

(58) Field of Classification Search
CPC ..... E05D 2003/025; Y10T 403/32901; Y10T 403/32893
USPC ..... 24/71 J, 265 B, 265 WS; 16/330, 303
See application file for complete search history.

(56) References Cited

U.S. PATENT DOCUMENTS

| | | | | |
|---|---|---|---|---|
| 2,075,304 | A * | 3/1937 | Sand | A44C 5/14 224/177 |
| 2,638,652 | A * | 5/1953 | Ruf | A44C 5/185 24/265 WS |
| 2,707,800 | A * | 5/1955 | Popper | G04B 37/12 16/296 |
| 5,551,125 | A * | 9/1996 | Adams | E05D 7/1022 16/229 |
| 6,911,891 | B2 | 6/2005 | Qiu et al. | |
| 8,506,158 | B2 | 8/2013 | Keung et al. | |
| 9,668,550 | B2 | 6/2017 | Seo et al. | |
| 10,782,734 | B2 | 9/2020 | Inagaki et al. | |
| 11,096,455 | B2 | 8/2021 | Douglas | |
| 11,994,906 | B2 | 5/2024 | Franklin et al. | |
| 12,369,695 | B1 * | 7/2025 | Feinstein | A44C 5/06 |
| 12,383,031 | B1 * | 8/2025 | Feinstein | A44C 5/06 |
| 2003/0116596 | A1 * | 6/2003 | Terasawa | A44C 5/0007 224/179 |
| 2009/0001232 | A1 * | 1/2009 | Seo | F16M 13/04 248/176.1 |
| 2013/0125344 | A1 * | 5/2013 | Courbon | E05D 11/1078 16/342 |
| 2014/0059818 | A1 * | 3/2014 | Catanese | A44C 5/24 24/71 J |
| 2019/0318591 | A1 | 10/2019 | Khoshkava et al. | |
| 2024/0188694 | A1 | 6/2024 | Vartanov et al. | |
| 2025/0134438 | A1 | 5/2025 | Chang | |

FOREIGN PATENT DOCUMENTS

| | | | |
|---|---|---|---|
| EP | 4249978 | A1 | 9/2023 |
| GB | 2445572 | A | 7/2008 |

OTHER PUBLICATIONS

Machine Translation of CH705215 B1.
Machine Translation of CN204062396U.

* cited by examiner

BAND WITH BISTABLE ACTUATION MECHANISM EMPLOYING FLEXIBLE ELEMENT

FIELD OF THE INVENTION

This disclosure relates generally to bands of material, such as for a watchband or other attachment or fixation system, employing bistable actuators to achieve a biased-open configuration and a biased-closed configuration of the band, and that employ flexible elements in order to achieve their bistability.

BACKGROUND OF THE INVENTION

Electronic devices and other apparatuses, such as wearable devices like smart watches, heart rate monitors, or fitness monitors, may be attached to one or more body parts of a user utilizing attachment structures, such as bands. To meet various fitting requirements, it is preferred that wearable bands have open and closed positions, and that is relatively easy for the wearer to switch between the two. It is further preferred that wearable bands, especially those to be worn on a wrist or arm, require very simple one-handed operation. Most preferable would be a wearable band that requires no use of the opposite hand other than to position or place the object on the desired location, after which the band is capable of completing the attachment by itself automatically as a hands-free operation upon activation or triggering by the wearer.

Conventional bands, such as watch bands, jewelry bands, magnetic health bands, bracelets, and necklaces, typically include expanding linkages and non-expanding linkages. However, such bands often are very delicate and flimsy and do not hold up well to physical exercise, fitness activities and sports.

Most conventional bands use only clasps to open and close the bands. Traditional clasp mechanisms come in various forms. Buckle and tether clasp mechanisms rely on mechanical features to keep the band or flap closed. Buckle and tether mechanisms can provide one-handed operation and can be adjusted, but they are often not easy to use in one handed operation. Hook-and-loop fasteners, such as Velcro®-like fasteners, can be adjusted and opened or closed by one hand, but they are not aesthetically pleasing. Button and hole clasps can be adjustable if there are multiple holes, but they are difficult to operate one-handed and the length adjustment is limited by the locations of the holes. Magnetic closure mechanisms use a post and hole configuration for alignment of the magnetic closure for mechanical retention in shear. Such magnetic closures are operable by one-hand but have limitations when used alone.

Generally, conventional bands with clasps require somewhat complicated manipulation by the wearer, which may make them difficult to wear for those with various disabilities, for the very young, for the very old, etc. Thus, there is still a need to provide an improved wearable band which is suitable for one handed or even hands free operation. Desirably, the wearable band is able to clasp automatically upon putting onto a body with little, if any, input required for the wearer to activate/trigger the band from the opened to the closed position.

The present invention, therefore, aims to remedy the problems associated with known bands by providing a band, such as a watch band or other wearable band, that is suitable for very simple one handed or hands free operation and that can assemble around a body part upon being positioned onto the body part with little, if any, input required for the wearer to activate/trigger the band from the opened to the closed position.

SUMMARY OF THE INVENTION

The present invention achieves these objectives by providing a band of material, such as for a watchband or other attachment or fixation system, utilizing one or more deflectable elements, such as flexible beams, to achieve bias opened and bias closed configurations.

In accordance with one particular exemplary embodiment of the present invention, a band configured to wrap around and be secured to an object has at least one actuator including a first member and a second member pivotably connected to one another so as to be pivotable with respect to each other about a pivot axis between an open position and a closed position. The first member includes a body portion with a pair of deformable beams extending therefrom. Each of the pair of deformable beams has an end attached to the body portion and a free end, and each of the deformable beams includes a protuberance extending therefrom and disposed toward the free end thereof. The second member includes a series of ridges and valleys formed therein that are sized, shaped and positioned to cooperate with the protuberances extending from the pair of deformable beams. In the open position and the closed position, the protuberances extending from the pair of deformable beams align with the valleys formed in the second member, such that the pair of deformable beams are in a relaxed state and generally parallel with each other, and when the first and second members are pivoted with respect to each other to positions between the open position and the closed position, the protuberances extending from the pair of deformable beams cooperate with the ridges formed in the second member, such that the pair of deformable beams are elastically deformed so as to no longer be parallel with each other, and so as to store strain energy.

In some embodiments, each of the ridges comprises a peak defining a threshold position, such that when the first and second members are pivoted with respect to each other to positions between the open position and the closed position and the protuberances are disposed to a first side of the peaks, the first and second members are biased toward the open position by forces created by the stored strain energy, and such that when the first and second members are pivoted with respect to each other to positions between the open position and the closed position and the protuberances are disposed to a second side of the peaks, the first and second members are biased toward the closed position by forces created by the stored strain energy. In certain of these embodiments, when the first and second members are pivoted with respect to each other to positions between the open position and the closed position, the protuberances extending from the pair of deformable beams cooperate with the ridges formed in the second member, such that the pair of deformable beams are elastically deformed away from each other.

In some embodiments, the second member and each of the pair of deformable beams of the first member have holes formed therein along the pivot axis, and the band further comprises a pin disposed in the holes, so as to provide for the pivotable connection between the first member and the second member.

In some embodiments, the first member further comprises a pair of fixed beams extending from the body portion, each of the pair of fixed beams having an end attached to the body portion and a free end, the pair of fixed beams being generally parallel with each other, and, when the pair of deformable beams are in the relaxed state, the pair of fixed beams being generally parallel with the pair of deformable beams. In certain of these embodiments, when the first and second members are pivoted with respect to each other to positions between the open position and the closed position, the protuberances extending from the pair of deformable beams cooperate with the ridges formed in the second member, such that the each of the pair of deformable beams is elastically deformed toward one of the pair of fixed beams. In certain embodiments, the second member, each of the pair of deformable beams of the first member, and each of the fixed beams of the first member have holes formed therein along the pivot axis, and the band further comprises a pin disposed in the holes, so as to provide for the pivotable connection between the first member and the second member.

In some embodiments, the band further comprises a body and a strap, and the at least one actuator is configured to pivotably connect the body to the strap. In certain of these embodiments, the first member is affixed to the strap and the second member is affixed to the body.

In some embodiments, the at least one actuator comprises two actuators, and the band further comprises a body and two straps, each of the two actuators being configured to pivotably connect one of the two straps to the body. In certain of these embodiments, the first member of each of the two actuators is affixed to one of the two straps and the second member of each of the two actuators is affixed to the body. In certain embodiments, the body comprises a watch body and the two straps comprise a watchband, whereby the band comprises a watch and the object comprises a wrist of a wearer. In certain embodiments, the band further comprises a closure affixing the two straps together when the two actuators are in the closed position. In certain of these embodiments, the closure comprises a magnetic closure. In certain embodiments, each of the two straps comprises a flexible material. In certain embodiments, each of the two straps comprises a plurality of links.

In some embodiments, the open position and the closed position comprise stable positions such that the open position and the closed position are maintained without external forces being applied thereto.

In accordance with another aspect of the present invention, a band configured to wrap around and be secured to an object has at least one actuator comprising a first member and a second member pivotably connected to one another so as to be pivotable with respect to each other about a pivot axis between an open position and a closed position. The first member comprises a body portion and a pair of deformable beams extending from the body portion. Each of the pair of deformable beams has an end attached to the body portion and a free end, and each of the deformable beams includes a protuberance extending therefrom and disposed toward the free end thereof. The first member further comprises a pair of fixed beams extending from the body portion, each of the pair of fixed beams having an end attached to the body portion and a free end. The pair of fixed beams are generally parallel with each other. The second member comprises a series of ridges and valleys formed therein that are sized, shaped and positioned to cooperate with the protuberances extending from the pair of deformable beams. In the open position and the closed position, the protuberances extending from the pair of deformable beams align with the valleys formed in the second member, such that the pair of deformable beams are in a relaxed state and generally parallel with each other and with the pair of fixed beams. When the first and second members are pivoted with respect to each other to positions between the open position and the closed position, the protuberances extending from the pair of deformable beams cooperate with the ridges formed in the second member, such that the pair of deformable beams are elastically deformed away from each other so as to no longer be parallel with each other and such that the each of the pair of deformable beams is elastically deformed toward one of the pair of fixed beams, and so as to store strain energy. The second member, each of the pair of deformable beams of the first member, and each of the fixed beams of the first member have holes formed therein along the pivot axis. A pin is disposed in the holes, so as to provide for the pivotable connection between the first member and the second member. Each of the ridges comprises a peak defining a threshold position, such that when the first and second members are pivoted with respect to each other to positions between the open position and the closed position and the protuberances are disposed to a first side of the peaks, the first and second members are biased toward the open position by forces created by the stored strain energy, and such that, when the first and second members are pivoted with respect to each other to positions between the open position and the closed position and the protuberances are disposed to a second side of the peaks, the first and second members are biased toward the closed position by forces created by the stored strain energy.

In some embodiments, the band further comprises a body and a strap, and the at least one actuator is configured to pivotably connect the body to the strap. In certain of these embodiments, the first member is affixed to the strap and the second member is affixed to the body.

In some embodiments, the at least one actuator comprises two actuators, the band further comprises a body and two straps, and each of the two actuators is configured to pivotably connect one of the two straps to the body. In certain of these embodiments, the first member of each of the two actuators is affixed to one of the two straps and the second member of each of the two actuators is affixed to the body. In certain embodiments, the body comprises a watch body and the two straps comprise a watchband, whereby the band comprises a watch and the object comprises a wrist of a wearer.

In some embodiments, the band further comprises a closure affixing the two straps together when the two actuators are in the closed position. In certain embodiments, the closure comprises a magnetic closure. In certain embodiments, each of the two straps comprises a flexible material. In certain embodiments, each of the two straps comprises a plurality of links.

In some embodiments, the open position and the closed position comprise stable positions such that the open position and the closed position are maintained without external forces being applied thereto.

The present invention, as set out above in various respects, provides a band, such as a watch band or other wearable band, that is suitable for very simple one handed or hands free operation and that can assemble around a body part upon being positioned onto the body part with little, if any, input required for the wearer to activate/trigger the band from the opened to the closed position.

Other features and advantages of the invention will become more apparent from consideration of the following drawings and written description.

DETAILED DESCRIPTION OF THE INVENTION

Figure 1A:
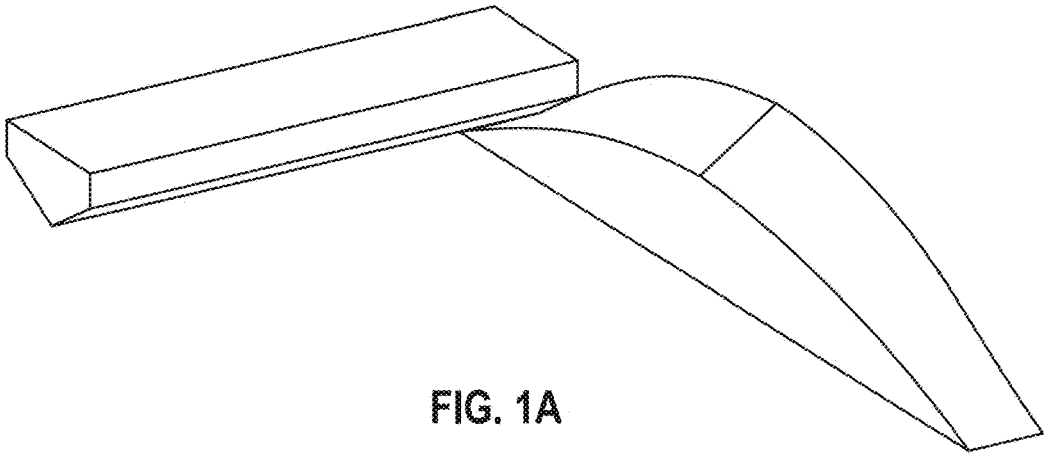
FIGS. 1A-1C schematically depict an exemplary bistable arrangement, particularly, the deflection of a flexible beam between two stable positions (FIG. 1A and FIG. 1C), as well as a central unstable position (FIG. 1B)

The present invention may be further understood with reference to the following description and the appended drawings, wherein like elements are referred to with the same reference numerals. The exemplary embodiments of the present invention describe bands used as wearables configured to wrap around a body part (e.g., a wrist, an ankle, etc.) of a wearer, in particular a watch band. It should be understood, however, that the present invention may be implemented in various other configurations and on various other scales, both smaller and larger than typical wearables.

It has been proposed to employ bistable arrangements in connection with hinge designs and the like, with two stable equilibrium positions separated by unstable positions. These arrangements gain their bistable behavior from energy of various types created depending on the relative positioning between the two hinge components. Traditionally, bistability in connection with hinge components has been achieved by employing springs, magnets, spring-loaded detents or the like. However, these mechanisms may suffer from various drawbacks in certain situations relating to such considerations as cost, complexity, robustness, etc.

The present invention obviates many of these deficiencies by relying on a deflectable beam approach to achieving bistability. This approach integrates desired mechanism motion and strain energy to create bistable arrangements with dramatically reduced part count and/or cost as compared to traditional mechanisms incorporating rigid links, joints, springs and/or magnets. As a deflection is applied to a beam (causing elastic deformation thereof), the arrangement rapidly transitions from one stable position to the other. The force-deflection response for a typical deflectable beam is illustrated schematically and graphically in FIGS. 1A-1C and FIG. 2.

Figure 1B:
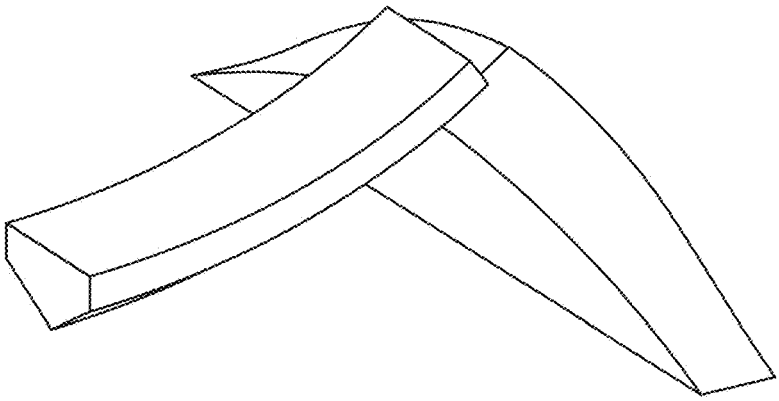
Figure 1C:
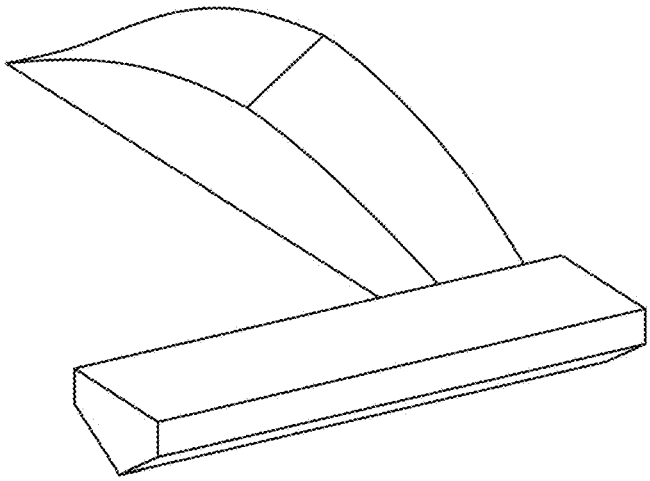
Figure 2:
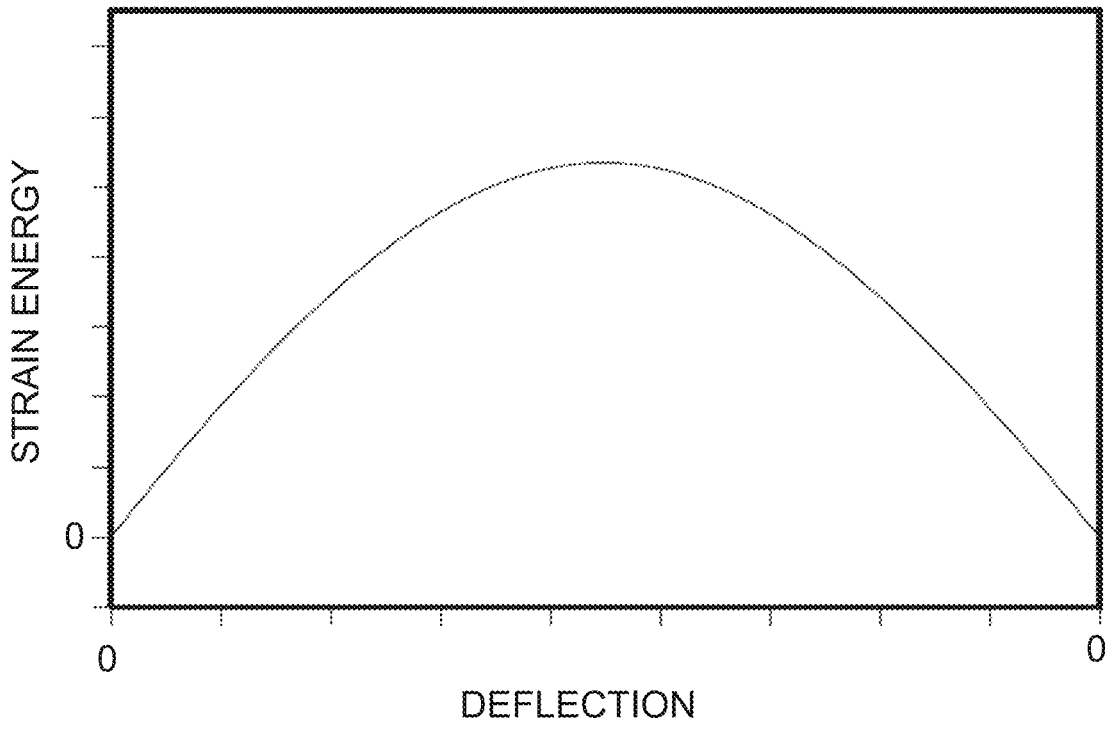
FIG. 2 is a graphical representation showing the relationship between strain energy and deflection of the flexible beam at positions corresponding to FIGS. 1A-1C, as well as positions therebetween.

As can be seen, bistable deflectable beam arrangements do not require power to be held in either of their stable positions (as indicated at the two deflection positions 0 shown in FIG. 2 and the corresponding beam positions shown in FIGS. 1A and 1C). As can also be seen, as the beam is deflected up a ridge toward a peak deflection position (shown in FIG. 1B), strain forces are created urging the beam back toward one of its two stable positions. Depending on which side of the ridge's peak the beam is positioned, as seen in FIG. 1B (note also peak of graph shown in FIG. 2), the strain energy urges the beam to slide down the ridge toward either of the stable positions illustrates in FIGS. 1A and 1C.

The present invention relies upon this type of deflectable beam created bistability to provide actuators incorporated into the inventive band of material, such as for a watchband or other wearable band.

Figure 3A:
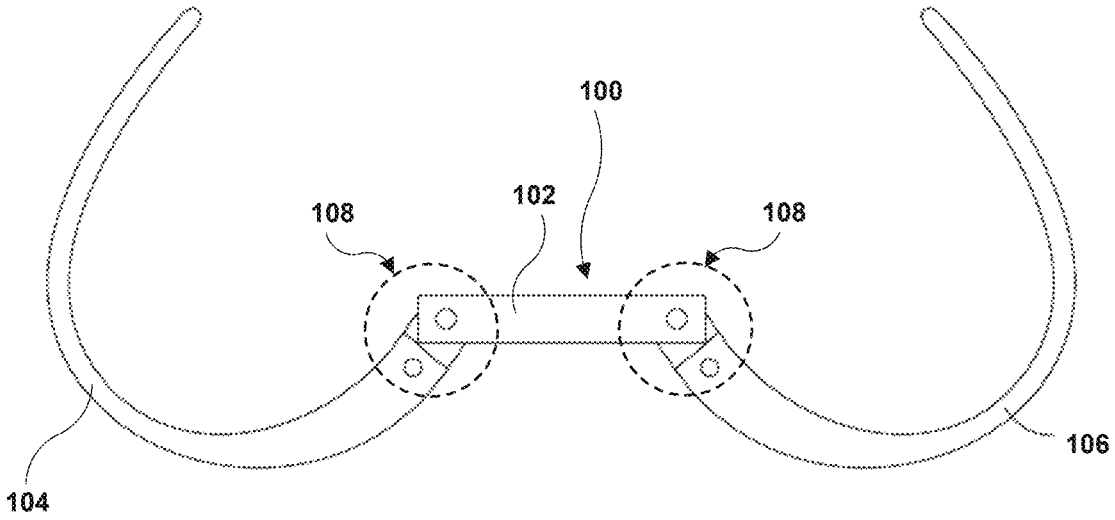
FIGS. 3A and 3B are side elevational schematic views of a watch incorporating a band configured in accordance with an exemplary embodiment of the present invention incorporating a pair of the bistable actuators illustrating the actuators in the stable open position (FIG. 3A) and the stable closed position (FIG. 3B)
Figure 3B:
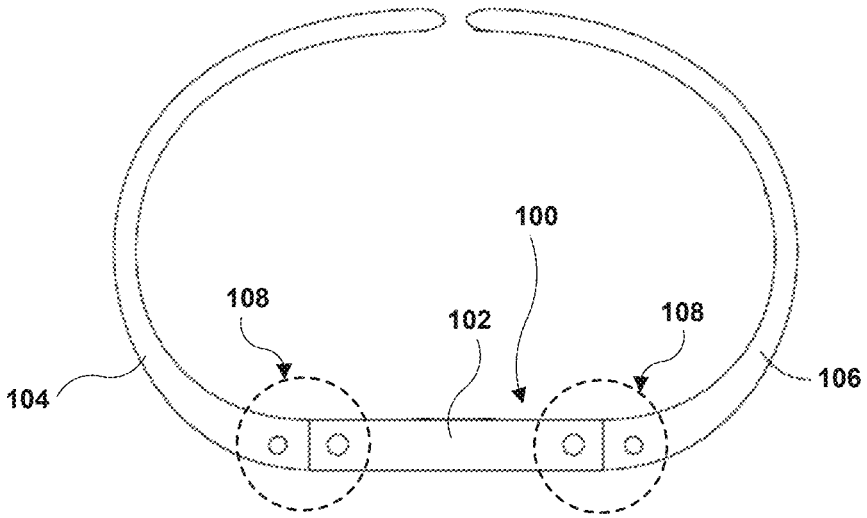

Referring now to FIGS. 3A and 3B, a band (100) configured to wrap around and be secured to an object (not shown) in accordance with one particular exemplary embodiment of the present invention includes a body (102) and two straps (104, 106) pivotably connected to the body (102) via two actuators (108) so as to be pivotable with respect to each other between an open position (shown in FIG. 3A) and a closed position (shown in FIG. 3B). The straps (104, 106) are pivotably connected to the body (102) at opposite ends thereof. In the particular illustrated embodiment, the body (102) is shown to comprise a watch body, while the straps (104, 106) are shown to comprise watch straps, whereby the band (100) comprises a watch and the object around which the band (100) is configured to wrap and be secured comprises the wrist of a wearer. However, it must be recognized that such is not required, and it is contemplated that the band (100) may take any of numerous forms.

Figure 4A:
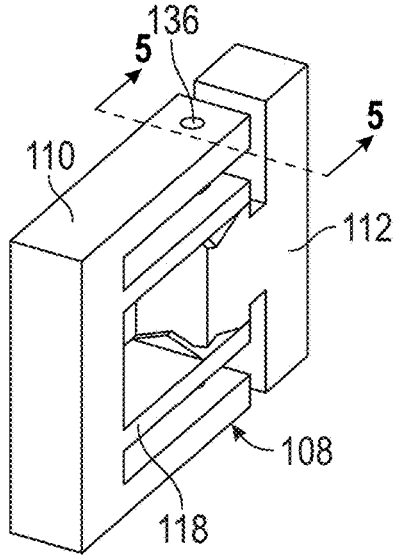
FIGS. 4A-4C are side isometric views showing portions of a bistable actuator employing deflectable elements configured in accordance with an exemplary embodiment of the present invention illustrating the actuator in the stable closed position (FIG. 4A), the stable open position (FIG. 4C) and an intermediate unstable position (FIG. 4B)
Figure 4B:
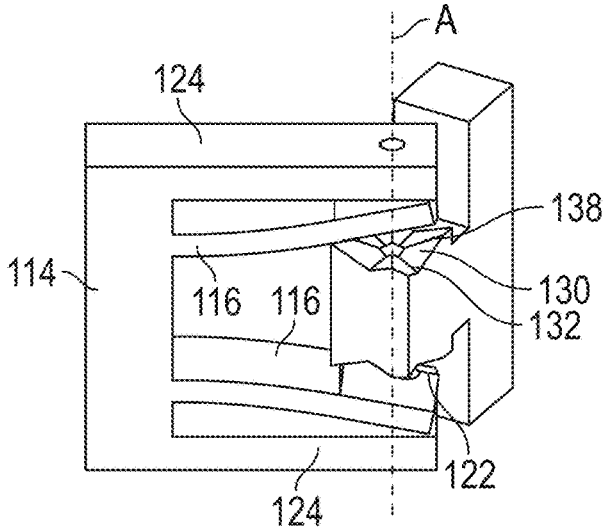
Figure 4C:
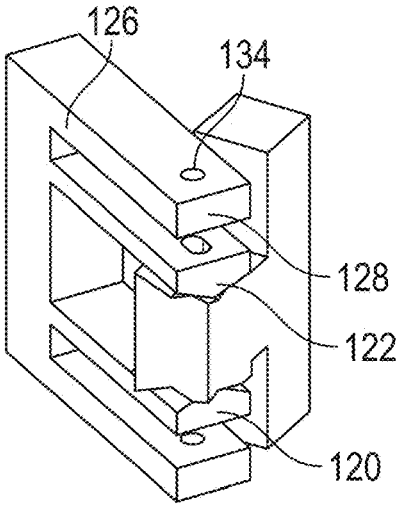

Turning now to FIGS. 4A-4C, a first exemplary embodiment of each of the actuators (108) is illustrated in the stable closed position (shown in FIG. 4A), the stable open position (shown in FIG. 4C) and an intermediate unstable position (shown in FIG. 4B).

Figure 5:
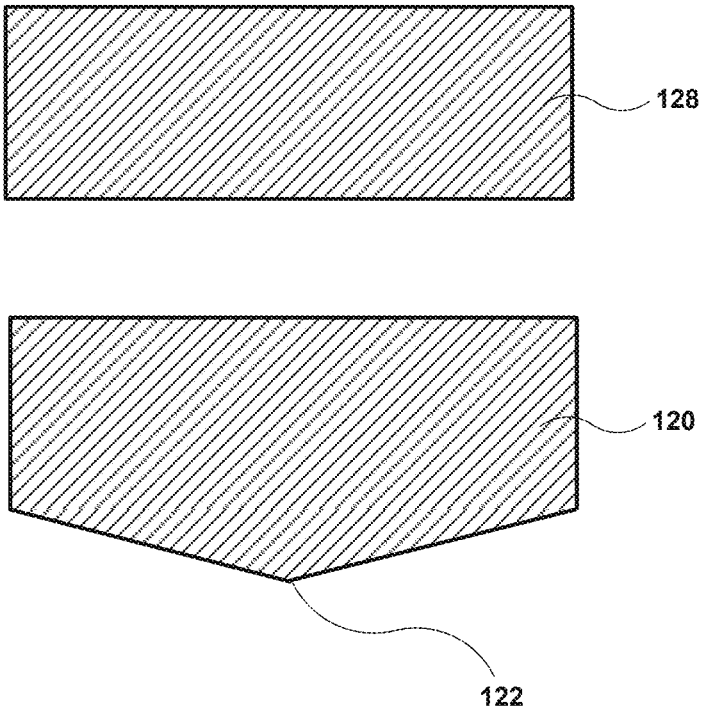
FIG. 5 is a cross-sectional view of a portion of the actuator of FIGS. 4A-4C, taken along plane 5-5 shown in FIG. 4A.

Each actuator (108) includes a first member (110) and a second member (112) pivotably connected to one another so as to be pivotable with respect to each other about a pivot axis (A) between an open position (shown in FIG. 4C) and a closed position (shown in FIG. 4A). The first member (110) comprises a body portion (114) and a pair of deformable beams (116) extending from the body portion (114). In the embodiment shown in FIGS. 4A-4C, the pair of deformable beams (116) lie in an imaginary plane that is generally parallel to the pivot axis (A), although such is not strictly required (see, e.g., the embodiment shown in FIGS. 6A and 6B, wherein the deformable beams lie on a curved surface). Each of the pair of deformable beams (116) has an end (118) attached to the body portion (114) and a free end (120), and each of the deformable beams (116) includes a protuberance (122) extending therefrom and disposed toward the free end (120) thereof (best seen in FIG. 5).

The first member (110) further comprises a pair of fixed beams (124) extending from the body portion (114), each of the pair of fixed beams (124) having an end (126) attached to the body portion (114) and a free end (128). The pair of fixed beams (124) are generally parallel with each other. In the embodiment shown in FIGS. 4A-4C, the pair of fixed beams (124) lie in the same imaginary plane that is generally parallel to the pivot axis (A) as do the deformable beams (116), although such is not strictly required (see, e.g., the embodiment shown in FIGS. 6A and 6B, wherein the fixed beams lie on a curved surface).

The second member (112) comprises a series of ridges (130) and valleys (132) formed therein that are sized, shaped and positioned to cooperate with the protuberances (122) extending from the pair of deformable beams (116), as best seen in FIG. 4B. In the open position (shown in FIG. 4C) and the closed position (shown in FIG. 4A), the protuberances (122) extending from the pair of deformable beams (116) align with the valleys (132) formed in the second member (112), such that the pair of deformable beams (116) are in a relaxed state and generally parallel with each other and with the pair of fixed beams (124), as seen in FIGS. 4A and 4C.

When the first and second members (110, 112) are pivoted with respect to each other to positions between the open position and the closed position (for example to the intermediate position shown in FIG. 4B), the protuberances (122) extending from the pair of deformable beams (116) cooperate with the ridges (130) formed in the second member (112), such that the pair of deformable beams (116) are elastically deformed away from each other so as to no longer be parallel with each other and such that each of the pair of deformable beams (116) is elastically deformed toward one of the pair of fixed beams (124), and so as to store strain energy.

The second member (112), each of the pair of deformable beams (116) of the first member (110), and each of the fixed beams (124) of the first member (110) have holes (134) formed therein along the pivot axis (A). A pin (136) is disposed in the holes (134), so as to provide for the pivotable connection between the first member (110) and the second member (112). It is noted that the pin (136) is shown in FIG. 4A, but is omitted from FIGS. 4B and 4C merely for the sake of clarity.

As best seen in FIG. 4B, each of the ridges (130) in the second member (112) comprises a peak (138) defining a threshold position, such that when the first and second members (110, 112) are pivoted with respect to each other to positions between the open position (shown in FIG. 4C) and the closed position (shown in FIG. 4A) and the protuberances (122) are disposed to a first side of the peaks (138), the first and second members (110, 112) are biased toward the open position (shown in FIG. 4C) by forces created by stored strain energy caused by the deformation of the deformable beams (116), and such that, when the first and second members (110, 112) are pivoted with respect to each other to positions between the open position (shown in FIG. 4C) and the closed position (shown in FIG. 4A) and the protuberances (122) are disposed to a second side of the peaks (138), the first and second members (110, 112) are biased toward the closed position (shown in FIG. 4A) by forces created by stored strain energy caused by the deformation of the deformable beams (116).

In view of this cooperation between the protuberances (122) of the deformable beams (116) of the first member (110) and the ridges (130) and valleys (132) of the second member (112), it should be apparent that the open position (shown in FIG. 4C) and the closed position (shown in FIG. 4A) comprise stable positions such that the open position and the closed position are maintained without external forces being applied thereto.

In order to achieve the desired elastic deformation of the deformable beams (116), and the consequent storage of strain energy, it has been found that forming the deformable beams (116) from various polymers provide acceptable results. Examples include polypropylene, acrylonitrile butadiene styrene (ABS), acrylic, poly (lactic acid) (PLA), silicone, rubber, and polyethylene terephthalate glycol (PETG), as well as flexible glass. The same materials can be employed for other portions of the first member (110) for ease of manufacture, as well as for the second member (112). Alternately, different materials may be used for these latter sections, such as various metals including stainless steel, aluminum, copper and titanium, as can be carbon fiber, and wood. These materials, and various combinations thereof, can be layered with other materials (such as silicone, fabric, leather, etc.) to increase comfort and/or aesthetic appeal. Of these materials, the following have been found to be particularly desirable: polypropylene, acrylonitrile butadiene styrene (ABS), stainless steel, aluminum and combinations thereof. Of course, those skilled in the art will recognize that other materials now known or later developed may also be used instead of or in conjunction with those listed. Additionally, various combinations of the listed materials, with each other or with non-listed materials, may also provide desirable results.

Figure 6A:
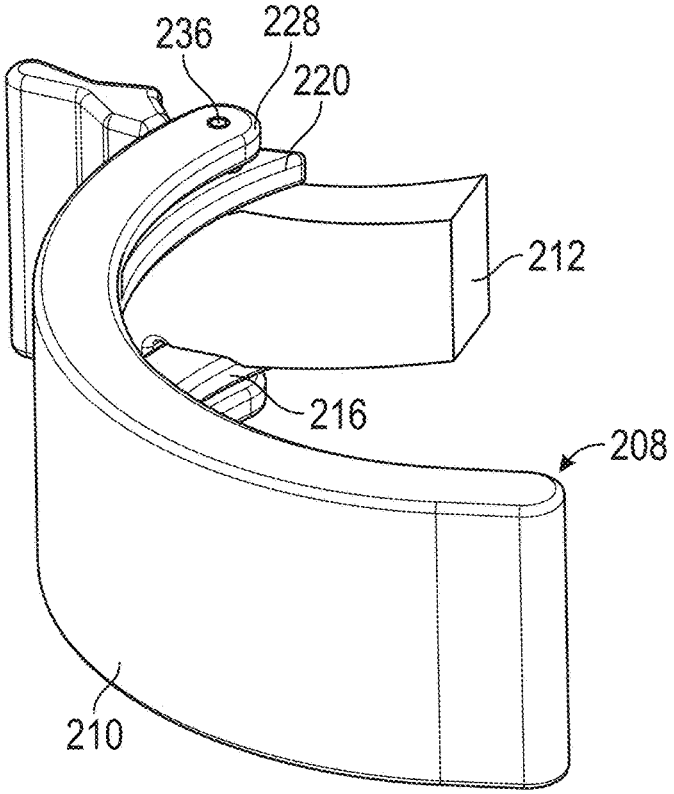
FIGS. 6A and 6B are side isometric views showing portions of a bistable actuator employing deflectable elements configured in accordance with a second exemplary embodiment of the present invention illustrating the actuator in the stable open position (FIG. 6A) and the stable closed position (FIG. 6B)
Figure 6B:
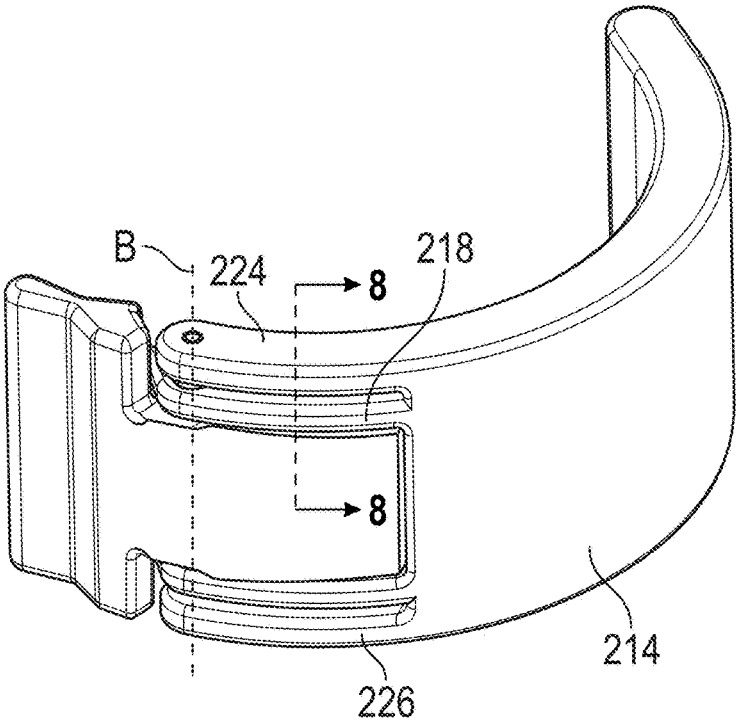

Referring now to FIGS. 6A and 6B, a second embodiment of a bistable actuator (208) in accordance with the present invention is shown in the stable open position (shown in FIG. 6A), the stable closed position (shown in FIG. 6B).

Figure 8:
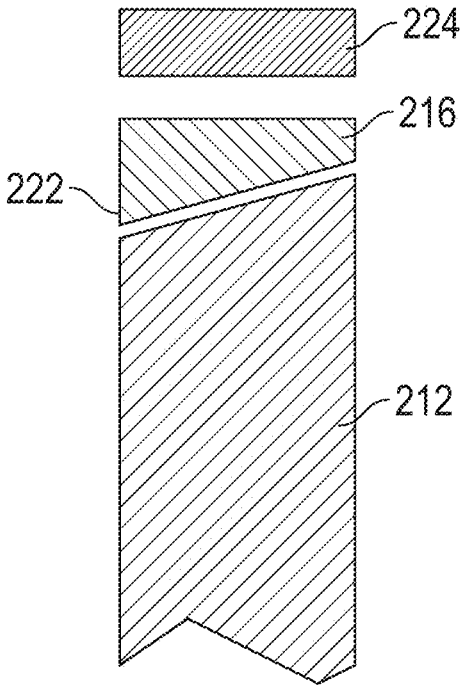
FIG. 8 is a cross-sectional view of portions of the actuator of FIGS. 6A and 6B, taken along plane 8-8 shown in FIG. 6B.

Each actuator (208) includes a first member (210) and a second member (212) pivotably connected to one another so as to be pivotable with respect to each other about a pivot axis (B) between an open position (shown in FIG. 6A) and a closed position (shown in FIG. 6B). The first member (210) comprises a body portion (214) and a pair of deformable beams (216) extending from the body portion (214). In the embodiment shown in FIGS. 6A and 6B, the pair of deformable beams (216) lie on a curved surface. Each of the pair of deformable beams (216) has an end (218) attached to the body portion (214) and a free end (220), and each of the deformable beams (216) includes a protuberance (222) extending therefrom and disposed toward the free end (220) thereof. As best seen in FIG. 8, in this embodiment, the protuberance (222) takes the form of a sloped surface.

The first member (210) further comprises a pair of fixed beams (224) extending from the body portion (214), each of the pair of fixed beams (224) having an end (226) attached to the body portion (214) and a free end (228). The pair of fixed beams (224) are generally parallel with each other. In the embodiment shown in FIGS. 6A and 6B, the pair of fixed beams (224) lie on the same curved surface as do the pair of deformable beams (216).

Figure 7:
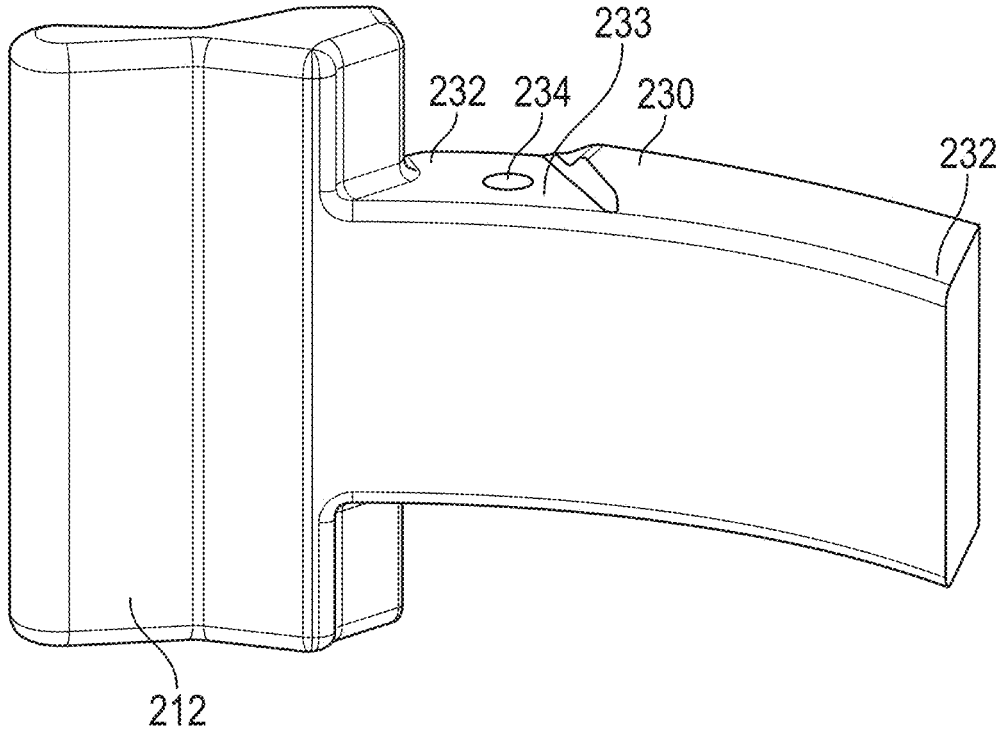
FIG. 7 is a side isometric view showing in more detail a portion of the actuator shown in FIGS. 6A and 6B.

The second member (212) comprises a series of ridges (230) and valleys (232) formed therein that are sized, shaped and positioned to cooperate with the protuberances (222) extending from the pair of deformable beams (216), as best seen in FIG. 7. In the open position (shown in FIG. 6A) and the closed position (shown in FIG. 6B), the protuberances (222) extending from the pair of deformable beams (216) align with the valleys (232) formed in the second member (212), such that the pair of deformable beams (216) are in a relaxed state and generally parallel with each other and with the pair of fixed beams (224), as seen in FIGS. 6A and 6B.

Again, as best seen in FIG. 7, in this embodiment, the ridges (230) and valleys (232) define channels (233) sized and shaped to receive the protuberances (222) ending from the pair of deformable beams (216) when in the open position (as best seen in FIG. 6A). The ridges (230) and valleys (232) are also configured to closely mate with the sloped surfaces defined by the protuberances (222) when in the closed position (as best seen in FIG. 8), in order to achieve the relaxed, stable closed position.

When the first and second members (210, 212) are pivoted with respect to each other to positions between the open position and the closed position (not shown), the protuberances (222) extending from the pair of deformable beams (216) cooperate with the ridges (230) formed in the second member (212), such that the pair of deformable beams (216) are elastically deformed away from each other so as to no longer be parallel with each other and such that the each of the pair of deformable beams (216) is elastically deformed toward one of the pair of fixed beams (224), and so as to store strain energy.

The second member (212), each of the pair of deformable beams (216) of the first member (210), and each of the fixed beams (224) of the first member (210) have holes (234) formed therein along the pivot axis (B). A pin (236) is disposed in the holes (234), so as to provide for the pivotable connection between the first member (210) and the second member (212).

In view of this cooperation between the protuberances (222) of the deformable beams (216) of the first member (210) and the ridges (230) and valleys (232) of the second member (212), it should be apparent that the open position (shown in FIG. 6A) and the closed position (shown in FIG. 6B) comprise stable positions such that the open position and the closed position are maintained without external forces being applied thereto.

In order to achieve the desired elastic deformation of the deformable beams (216), and the consequent storage of strain energy, it has been found that forming the deformable beams (216) from various polymers provide acceptable results. Examples include polypropylene, acrylonitrile butadiene styrene (ABS), acrylic, poly (lactic acid) (PLA), silicone, rubber, and polyethylene terephthalate glycol (PETG), as well as flexible glass. The same materials can be employed for other portions of the first member (210) for ease of manufacture, as well as for the second member (212). Alternately, different materials may be used for these latter sections, such as various metals including stainless steel, aluminum, copper and titanium, as can be carbon fiber, and wood. These materials, and various combinations thereof, can be layered with other materials (such as silicone, fabric, leather, etc.) to increase comfort and/or aesthetic appeal. Of these materials, the following have been found to be particularly desirable: polypropylene, acrylonitrile butadiene styrene (ABS), stainless steel, aluminum and combinations thereof. Of course, those skilled in the art will recognize that other materials now known or later developed may also be used instead of or in conjunction with those listed. Additionally, various combinations of the listed materials, with each other or with non-listed materials, may also provide desirable results.

Figure 9A:
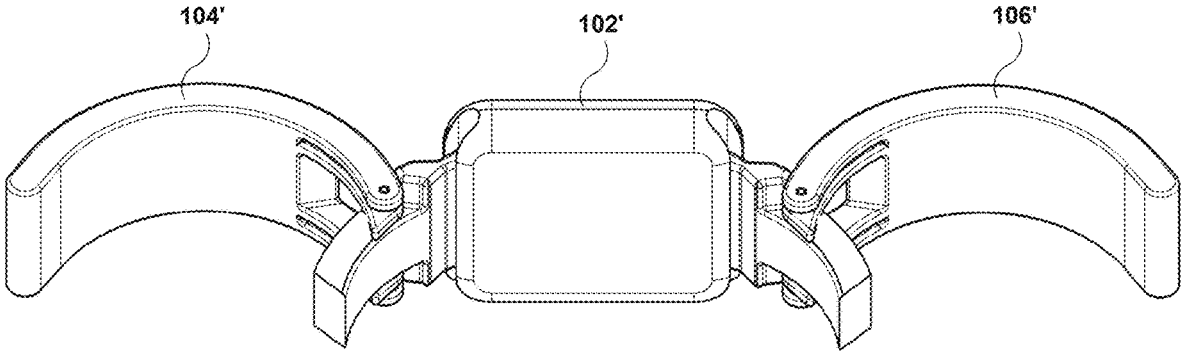
FIGS. 9A and 9B are side isometric views of an embodiment of a watch incorporating the actuator of FIGS. 6A and 6B shown in the stable open position (FIG. 9A) and the stable closed position (FIG. 9B)
Figure 9B:
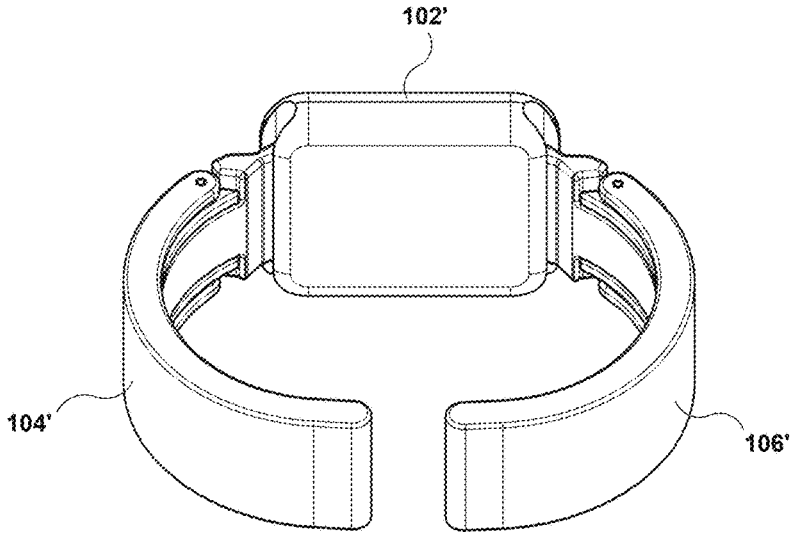

As shown in FIGS. 3A and 3B, the straps (104, 106) may comprise a strap of flexible material, such as leather, fabric, silicone, rubber or the like. FIGS. 9A and 9B show a similar embodiment of a watch having a watch body (102') incorporating the actuators shown in FIGS. 6A and 6B, and which also incorporate straps (104', 106') that are formed from a rigid or semi-rigid material, such as being formed from metals and/or polymers or the like.

Figure 10A:
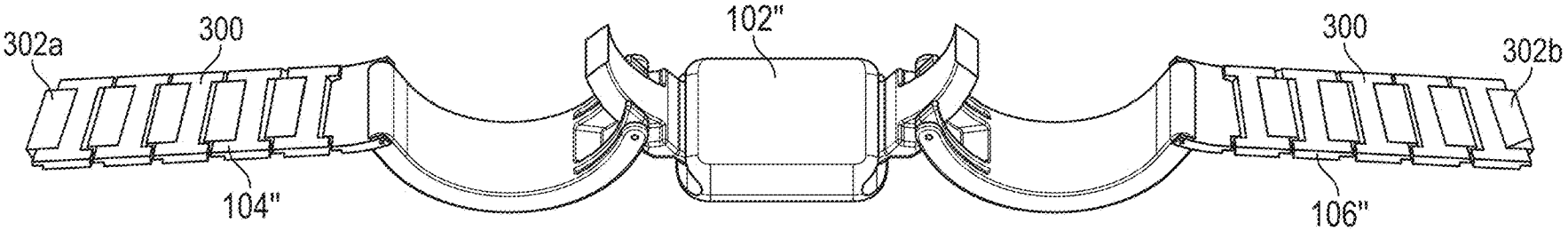
FIGS. 10A and 10B are side isometric views of another embodiment of a watch incorporating the actuator of FIGS. 6A and 6B shown in the stable open position (FIG. 10A) and the stable closed position (FIG. 10B).
Figure 10B:
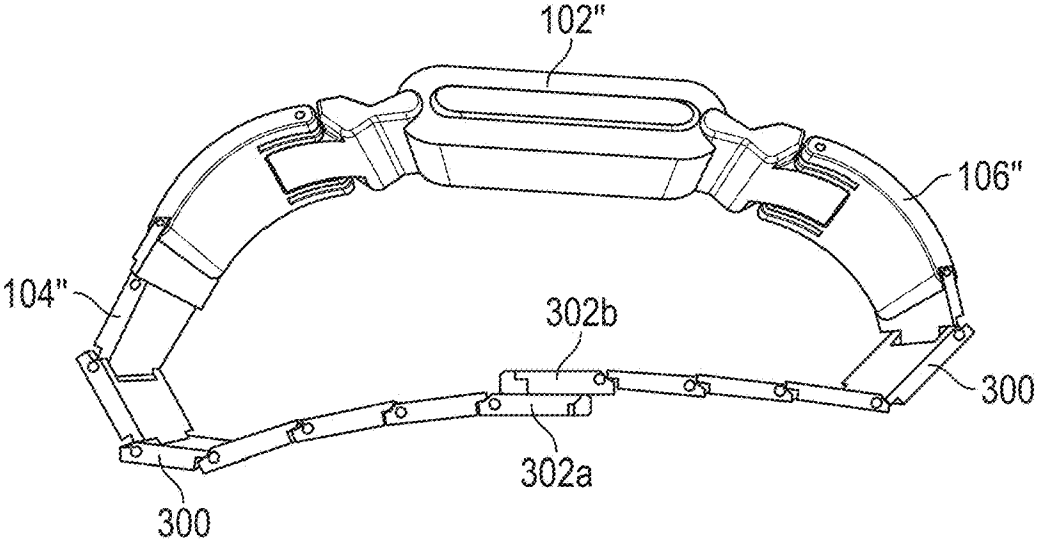

Instead, or in addition, the straps (104", 106") may comprise a plurality of links (300) as shown in FIGS. 10A and 10B, such that the bistable actuators, as discussed above, are used to trigger the opening and/or closing of the straps upon activation by a wearer, thereby facilitating one-handed operation. The links (300) may take the form of passive links, as are commonly known. If desired, however, the links (300) may take the form of active links, such as being spring biased or biased by operation of bistable compliant mechanisms, as shown and described in our copending U.S. patent application Ser. No. 19/076,629. Additionally, a combination of both passive links and active links—e.g., links employing the use of bistable compliant mechanisms—can be provided.

Also as shown in FIGS. 10A and 10B, the straps (104", 106") may be provided with a clasp or closure mechanism (302*a*, 302*b*) at ends thereof opposite to their ends pivotably connected to the body (102"), so as to provide for affixing of the straps (104", 106") together when the straps (104", 106") are in the closed position (shown in FIG. 10B). The clasp/closure (302*a*, 302*b*) may take the form of a magnetic closure or the like, although such is not required. On the other hand, when the straps (104', 106') are formed from a more rigid material, as is shown in FIGS. 9A and 9B, it may not be necessary and/or desirable to provide a clasp or closure mechanism.

It is contemplated that the body (102, 102', 102") and the straps (104, 104', 104", 106, 106', 106") configured in accordance with the present invention can be employed in a wide variety of applications. As discussed above in detail, FIGS. 3A, 3B, 9A, 9B, 10A and 10B show embodiments where the body (102, 102', 102") comprises a watch body and where the straps (104, 104', 104", 106, 106', 106") comprise straps for a watch band, such that the invention is implemented in a watch. However, many other applications are envisioned. Moreover, it is contemplated that more than three members may be employed. For example, there may be provided multiple double-sided members, similar to the body (102, 102', 102") connected end-to-end between two single ended members, similar to the straps (104, 104', 104", 106, 106', 106") in order to define an elongated and flexible band, such as an article of jewelry (e.g., a bracelet). Multiple other embodiments for use in various applications are also contemplated.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A band configured to wrap around and be secured to an object, the band comprising at least one actuator comprising:

a first member and a second member pivotably connected to one another so as to be pivotable with respect to each other about a pivot axis between an open position and a closed position;

wherein the first member comprises a body portion with a pair of deformable beams extending therefrom and with a pair of fixed beams extending therefrom, each of the pair of deformable beams having an end attached to the body portion and a free end, wherein each of the deformable beams includes a protuberance extending therefrom and disposed toward the free end thereof, wherein each of the pair of fixed beams has an end attached to the body portion and a free end, wherein the pair of fixed beams are generally parallel with each other, and wherein, when the pair of deformable beams are in the relaxed state, the pair of fixed beams are generally parallel with the pair of deformable beams;

wherein the second member comprises a series of ridges and valleys formed therein that are sized, shaped and positioned to cooperate with the protuberances extending from the pair of deformable beams;

wherein, in the open position and the closed position, the protuberances extending from the pair of deformable beams align with the valleys formed in the second member, such that the pair of deformable beams are in a relaxed state and generally parallel with each other;

wherein, when the first and second members are pivoted with respect to each other to positions between the open position and the closed position, the protuberances extending from the pair of deformable beams cooperate with the ridges formed in the second member, such that the pair of deformable beams are elastically deformed so as to no longer be parallel with each other, and so as to store strain energy;

wherein the second member, each of the pair of deformable beams of the first member, and each of the fixed beams of the first member have holes formed therein along the pivot axis; and further comprising a pin disposed in the holes, so as to provide for the pivotable connection between the first member and the second member.

2. The band of claim 1, wherein each of the ridges comprises a peak defining a threshold position;

wherein, when the first and second members are pivoted with respect to each other to positions between the open position and the closed position and the protuberances are disposed to a first side of the peaks, the first and second members are biased toward the open position by forces created by the stored strain energy, and wherein, when the first and second members are pivoted with respect to each other to positions between the open position and the closed position and the protuberances are disposed to a second side of the peaks, the first and second members are biased toward the closed position by forces created by the stored strain energy.

3. The band of claim 1 wherein, when the first and second members are pivoted with respect to each other to positions between the open position and the closed position, the protuberances extending from the pair of deformable beams cooperate with the ridges formed in the second member, such that the pair of deformable beams are elastically deformed away from each other.

4. The band of claim 1, when the first and second members are pivoted with respect to each other to positions between the open position and the closed position, the protuberances extending from the pair of deformable beams cooperate with the ridges formed in the second member, such that the each of the pair of deformable beams is elastically deformed toward one of the pair of fixed beams.

5. The band of claim 1, further comprising a body and a strap, wherein the at least one actuator is configured to pivotably connect the body to the strap.

6. The band of claim 5 wherein the first member is affixed to the strap and wherein the second member is affixed to the body.

7. The band of claim 1, wherein the at least one actuator comprises two actuators; and further comprising a body and two straps, wherein each of the two actuators is configured to pivotably connect one of the two straps to the body.

8. The band of claim 7 wherein the first member of each of the two actuators is affixed to one of the two straps and wherein the second member of each of the two actuators is affixed to the body.

9. The band of claim 8 wherein the body comprises a watch body and wherein the two straps comprise a watchband, whereby the band comprises a watch and the object comprises a wrist of a wearer.

10. The band of claim 7 further comprising a closure affixing the two straps together when the two actuators are in the closed position.

11. The band of claim 10 wherein the closure comprises a magnetic closure.

12. The band of claim 7 wherein each of the two straps comprises a flexible material.

13. The band of claim 7 wherein each of the two straps comprises a plurality of links.

14. A band configured to wrap around and be secured to an object, the band comprising at least one actuator comprising:

a first member and a second member pivotably connected to one another so as to be pivotable with respect to each other about a pivot axis between an open position and a closed position;

wherein the first member comprises:

a body portion;

a pair of deformable beams extending from the body portion, each of the pair of deformable beams having an end attached to the body portion and a free end, wherein each of the deformable beams includes a protuberance extending therefrom and disposed toward the free end thereof; and a pair of fixed beams extending from the body portion, wherein each of the pair of fixed beams has an end attached to the body portion and a free end, and wherein the pair of fixed beams are generally parallel with each other;

wherein the second member comprises a series of ridges and valleys formed therein that are sized, shaped and positioned to cooperate with the protuberances extending from the pair of deformable beams;

wherein, in the open position and the closed position, the protuberances extending from the pair of deformable beams align with the valleys formed in the second member, such that the pair of deformable beams are in a relaxed state and generally parallel with each other and with the pair of fixed beams;

wherein, when the first and second members are pivoted with respect to each other to positions between the open position and the closed position, the protuberances extending from the pair of deformable beams cooperate with the ridges formed in the second member, such that the pair of deformable beams are elastically deformed away from each other so as to no longer be parallel with each other and such that the each of the pair of deformable beams is elastically deformed toward one of the pair of fixed beams, and so as to store strain energy;

wherein the second member, each of the pair of deformable beams of the first member, and each of the fixed beams of the first member have holes formed therein along the pivot axis;

a pin disposed in the holes, so as to provide for the pivotable connection between the first member and the second member;

wherein each of the ridges comprises a peak defining a threshold position;

wherein, when the first and second members are pivoted with respect to each other to positions between the open position and the closed position and the protuberances are disposed to a first side of the peaks, the first and second members are biased toward the open position by forces created by the stored strain energy, and wherein, when the first and second members are pivoted with respect to each other to positions between the open position and the closed position and the protuberances are disposed to a second side of the peaks, the first and second members are biased toward the closed position by forces created by the stored strain energy.

15. The band of claim 14, further comprising a body and a strap, wherein the at least one actuator is configured to pivotably connect the body to the strap.

16. The band of claim 15 wherein the first member is affixed to the strap and wherein the second member is affixed to the body.

17. The band of claim 14, wherein the at least one actuator comprises two actuators; and further comprising a body and two straps, wherein each of the two actuators is configured to pivotably connect one of the two straps to the body.

18. The band of claim 17 wherein the first member of each of the two actuators is affixed to one of the two straps and wherein the second member of each of the two actuators is affixed to the body.

19. The band of claim 18 wherein the body comprises a watch body and wherein the two straps comprise a watchband, whereby the band comprises a watch and the object comprises a wrist of a wearer.

20. The band of claim 17 further comprising a closure affixing the two straps together when the two actuators are in the closed position.

21. The band of claim 20 wherein the closure comprises a magnetic closure.

22. The band of claim 17 wherein each of the two straps comprises a flexible material.

23. The band of claim 17 wherein each of the two straps comprises a plurality of links.

* * * * *